US007784250B2

(12) United States Patent
Grosskopf

(10) Patent No.: US 7,784,250 B2
(45) Date of Patent: Aug. 31, 2010

(54) METHOD OF FORMING CHILDPROOF BLISTER PACK

(75) Inventor: Glenn A. Grosskopf, Lake Zurich, IL (US)

(73) Assignee: Colbert Packaging Corporation, Lake Forest, IL (US)

( * ) Notice: Subject to any disclaimer, the term of this patent is extended or adjusted under 35 U.S.C. 154(b) by 0 days.

(21) Appl. No.: 12/130,363

(22) Filed: May 30, 2008

(65) Prior Publication Data

US 2008/0223747 A1 Sep. 18, 2008

Related U.S. Application Data

(63) Continuation of application No. 10/651,831, filed on Aug. 28, 2003, now Pat. No. 7,387,206.

(60) Provisional application No. 60/406,779, filed on Aug. 29, 2002.

(51) Int. Cl.
*B65B 47/00* (2006.01)

(52) U.S. Cl. ..... 53/453; 53/473; 53/558; 53/531

(58) Field of Classification Search ..... 53/452, 53/453, 473, 558, 559, 531, 173; 206/528, 206/530–532, 534, 534.1, 534.2, 538, 539, 206/461, 467

See application file for complete search history.

(56) References Cited

U.S. PATENT DOCUMENTS

| | | | |
|---|---|---|---|
| 1,011,697 | A | 12/1911 | Witkowski |
| 1,816,542 | A | 7/1931 | Mellin |
| 2,971,638 | A | 2/1961 | Allison et al. |
| 3,184,319 | A | 5/1965 | Fritsche |
| 3,322,613 | A | 5/1967 | Rasmussen |
| 3,394,802 | A | 7/1968 | Hershaft |
| 3,397,671 | A | 8/1968 | Hartman, Jr. et al. |
| 3,409,495 | A | 11/1968 | Rasmussen |
| 3,454,455 | A | 7/1969 | Rasmussen |
| 3,497,059 | A | 2/1970 | Watts, Jr. |
| 3,657,857 | A | 4/1972 | DeWoskin et al. |
| 4,125,190 | A | 11/1978 | Davie, Jr. et al. |

(Continued)

FOREIGN PATENT DOCUMENTS

| | | |
|---|---|---|
| GB | 2218072 A1 | 11/1989 |

*Primary Examiner*—Hemant M Desai
(74) *Attorney, Agent, or Firm*—Patzik, Frank & Samotny Ltd.

(57) ABSTRACT

A blister pack for dispensing pills that is childproof yet senior-friendly. The blister pack includes a substantially tear-resistant housing that encloses one or more blisters contained on a blister sheet and surrounded by criss-cross grain material to provide cut or tear resistance in multiple directions. In one embodiment, the cavities of the blisters are positioned such that the pills are aligned at an angle with respect to the corresponding dispensing slots on the housing in their normal position. The blisters are detachably attached to a zipper strip on the blister sheet to prevent undesired rotation of the blisters. Upon removal of the zipper strip, the blisters may be twisted until their pills are substantially aligned with their respective dispensing slot. The blisters may then be depressed to remove the pills from the cavities of the blisters by pushing the pills through the foil sheet that covers the slots. In another embodiment, the blisters must be released and slid within a channel to align the pill with the dispensing slot to be released.

9 Claims, 13 Drawing Sheets

U.S. PATENT DOCUMENTS

| | | | | |
|---|---|---|---|---|
| 4,354,598 | A | 10/1982 | Schillinger | |
| 4,485,920 | A | 12/1984 | Skylvik | |
| 4,613,057 | A | 9/1986 | Sacchetti et al. | |
| 4,664,262 | A | 5/1987 | White | |
| 4,706,815 | A | 11/1987 | Curtis et al. | |
| 4,778,054 | A | 10/1988 | Newell et al. | |
| 4,781,294 | A | 11/1988 | Croce | |
| 4,981,213 | A | 1/1991 | Dillon | |
| 5,119,952 | A | 6/1992 | Warriner, Jr. | |
| 5,240,110 | A | 8/1993 | Reichenbach et al. | |
| 5,244,091 | A | 9/1993 | Tannenbaum | |
| 5,323,907 | A | 6/1994 | Kalvelage | |
| 5,379,886 | A | 1/1995 | Brauner et al. | |
| 5,529,188 | A | 6/1996 | Coggswell | |
| 5,613,609 | A | 3/1997 | Hamilton et al. | |
| 5,799,821 | A | 9/1998 | Lambelet et al. | |
| 5,816,404 | A | 10/1998 | Seidler | |
| 5,830,548 | A | 11/1998 | Andersen et al. | |
| 6,010,784 | A | 1/2000 | Peterson | |
| 6,082,544 | A * | 7/2000 | Romick | 206/531 |
| 6,155,454 | A | 12/2000 | George et al. | |
| 6,212,791 | B1 | 4/2001 | Thompson et al. | |
| 6,230,964 | B1 | 5/2001 | Saito | |
| 6,253,920 | B1 | 7/2001 | Kallgren | |
| 6,279,736 | B1 | 8/2001 | Hekal | |
| 6,284,344 | B1 | 9/2001 | Barnes et al. | |
| 6,345,717 | B1 | 2/2002 | Flewitt | |
| 6,394,275 | B1 | 5/2002 | Paliotta et al. | |
| 6,667,363 | B2 | 12/2003 | Mizushiro et al. | |
| 6,676,584 | B2 | 1/2004 | Tachikawa et al. | |
| 6,726,015 | B2 | 4/2004 | Hulick | |
| 6,848,580 | B2 | 2/2005 | Paliotta et al. | |
| 6,997,320 | B1 * | 2/2006 | Kancsar et al. | 206/532 |
| 7,401,702 | B2 * | 7/2008 | Hession | 206/531 |

* cited by examiner

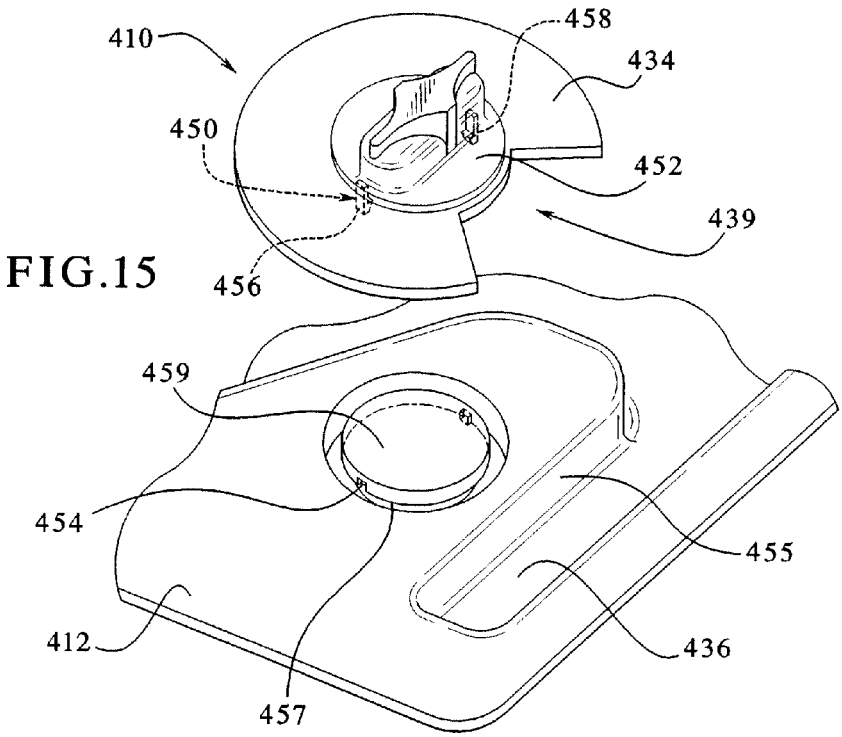
FIG.15
FIG.16
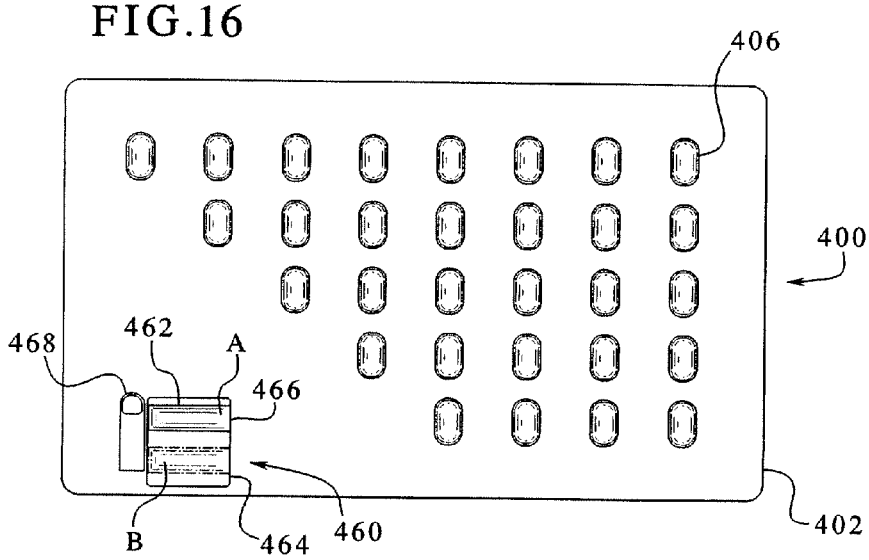

METHOD OF FORMING CHILDPROOF BLISTER PACK

This application is a continuation of U.S. application Ser. No. 10/651,831, filed on Aug. 28, 2003, now U.S. Pat. No. 7,387,206 issued on Jun. 17, 2008, the entirety of which is hereby incorporated by reference, which claims priority to U.S. Provisional Patent Application Ser. No. 60/406,779, the entirety of which is hereby incorporated by reference, filed on Aug. 29, 2002 and PCT Application Ser. No. PCT/US 2002/31224, filed on Oct. 1, 2002.

FIELD OF THE INVENTION

This invention relates in general to packaging, and more particularly to a blister pack that is childproof while also being senior-friendly, and more particularly to a blister pack that is constructed of a substantially tear-proof card material, and still more particularly to a blister pack that requires multiple senior-friendly steps to be performed in order to dispense the pills, while remaining substantially childproof.

BACKGROUND OF THE INVENTION

Heretofore, it has been well known to use blister packs for, among other things, the housing of pharmaceutical pills and liquids. Typically, blister packs consist of a series of blisters formed into a sheet of substantially impermeable clear plastic. The open end of the blister is generally covered with a thin metal foil or peel-off film that may be punctured or removed to access the pill inside the blister.

While the known blister packs work in many respects, problems have arisen in their use. First, known blister packs, similar to the use of a bottle of pills, do not provide for an easy way for consumers to track whether they have taken the necessary medication. Accordingly, if consumers cannot remember if they took the necessary medication, they will either have to forego taking a pill and risk the possibility of not taking the medication, or take another pill and risk the possibility of taking too much of the medication.

Second, because of the nature of the contents of many blister packs, especially pills, there is a need to make the blister packs substantially childproof. In that regard, in blister packs that include separate individual-pill blister packs that are kiss-cut to each other, it is known to have a protective layer over the foil to prevent the pills from being dispensed prior to the removal of the protective layer. The protective layer may generally be removed by using a fingernail to try and peel back the protective layer or by breaking off a removable corner piece of the blister pack and then peeling off the layer. Alternatively, the blister may be protected by a protective layer that includes a perforation in the middle of one of the sides that is designed to facilitate the tearing of the protective layer to access the pill. Such known embodiments are often very difficult to open by hand and often result in jagged or sharp edges. Because a large market for blister packs is senior citizens, who may experience diminished manual dexterity or hand pain from arthritis or the like, a manufacturer must take into account that it should be easy to operate and open, especially for senior citizens. Therefore, there is a need to develop a blister pack that is substantially tamper and tear proof, childproof and senior-friendly.

SUMMARY OF THE INVENTION

The present invention is an improvement over the prior blister packs in that the way that products contained therein are removed is unique and comprises an improvement over the prior art. In particular, the housing of the blister pack is preferably made from a substantially tear-resistant material to inhibit pilfering or undesired tearing of the card portion and encloses a blister sheet having a plurality of blisters is enclosed within the housing. A preferred material involves an SBS board coated on one side with a laminate having directional grains, such that when two housing sheets are placed on top of one another, the grains of the sheets substantially criss-cross to make the housing resistant to cutting or tearing in two directions.

In one embodiment, the cavities underneath the blisters are initially aligned such that the pills or other objects housed inside the cavities are substantially perpendicular to the dispensing slots on the bottom sheet of the housing. In order to prevent the blisters from being turned to dispense the pills, a zipper strip is kiss-cut or otherwise attached in perforated-cut fashion to the blisters. Other detachable attachment methods should be contemplated as being within the scope of the present invention. Upon removal or disengagement of the strip, the released blister may be turned until the blister's pill is aligned with its respective dispensing slot, thereby allowing the blister to be depressed so as to push the pill or capsule through the film covering the dispensing slot, in order to enable removal of the pill. While the example shown in this application describes the longitudinal axis of the dispensing slot as initially aligned at 90 degrees from the longitudinal axis of the blister and the pill contained therein, other angles from that axis should be considered as being within the scope of this invention. In another embodiment, the blisters need to be released and moved or slid into alignment with a slot to permit release of the pill contained therein.

An alternative embodiment of a childproof, senior-friendly blister pack comprises a pair of plastic sheets housed within the substantially tear-proof housing. One of the sheets includes a plurality of blisters that are preferably arranged in a series of rows and/or columns for housing a plurality of pills or other objects, which are retained within the blisters by a thin foil sheet. The second sheet comprises a series of channels that align with the series of rows and/or columns of blisters such that depressing the blister pushes the pill from the blister into the respective channel. The pill may then travel down the channel and into a second channel that traverses the series of channels. Once in the second channel, the pill may then proceed to a pill dispensing area that preferably comprises a dispensing slot that is initially displaced from the second channel or is otherwise covered to prevent the pill from being dispensed without further action.

In operation, the pill may be dispensed in a number of ways including through the use of a cover member that slides between a closed position (i.e., covering the dispensing slot) and an open position (i.e., uncovering the dispensing slot). A twistable or turnable blister may also be used wherein a flange of the blister may initially cover a dispensing slot when in the storage mode. Alternatively, the dispensing slot may be a part of the blister. Rotation of the blister thereby allows the dispensing slot to be uncovered or moved into alignment with the second channel to permit the pill to be dispensed. A zipper strip may also be employed to initially prevent movement of the turnable blister or sliding cover member.

It is therefore an object of the present invention to provide a new and improved blister pack that is substantially childproof, yet senior-friendly.

A further object of the present invention is to provide a blister pack wherein the housing is manufactured from a printable, substantially tear-resistant material.

Yet another object of the present invention is to provide a new and improved blister pack that requires a blister to be released so as to allow the blister to be moved, for example, turned or slid, in order to enable a pill to be dispensed, so as to prevent undesired dispensing of medication by children.

A further object of the present invention is to provide a new and improved blister pack that requires a blister to be released to slide into alignment with a slot to enable the pill to be dispensed so as to prevent undesired dispensing of medication by children.

A still further object of the present invention is to provide a blister pack that facilitates the tracking of pill consumption.

Another object of the present invention is to provide a blister pack that is easy and economical to manufacture.

Other objects, features and advantages of the invention will be apparent from the following detailed disclosure, taken in conjunction with the accompanying sheets of drawings, wherein like reference numerals refer to like parts.

BRIEF DESCRIPTION OF THE DRAWINGS

FIG. 15 is a perspective view of an embodiment of a turnable blister that may be temporarily locked in either an open or closed position.

FIG. 16 is a perspective view of another embodiment of a childproof, senior-friendly blister pack showing a slidable cover member to selectively cover the dispensing slot.

DETAILED DESCRIPTION OF THE INVENTION

Figure 1:
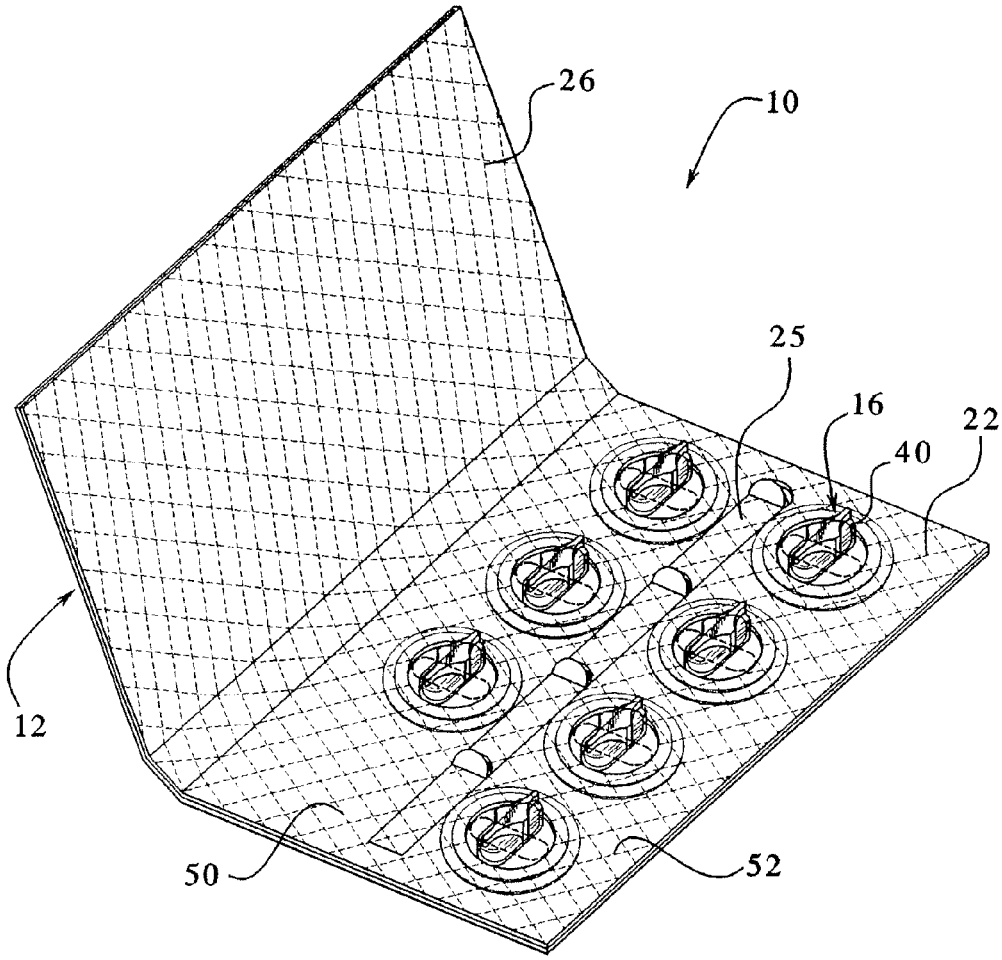
FIG. 1 is a perspective view of an embodiment of a childproof pharmaceutical dispensing blister pack showing the zipper strips of the blister sheet and housing top sheet still attached and the blisters in their normal non-dispensing position; the slots in the housing bottom sheet perpendicular to the blister cavities and in phantom; and a cover in the open position to access the blisters.

While this invention is susceptible of embodiment in many different forms, there is shown in the drawings and will herein be described in detail several specific embodiments, with the understanding that the present disclosure is to be considered merely an exemplification of the principles of the invention and the application is limited only to the appended claims.

Figure 2:
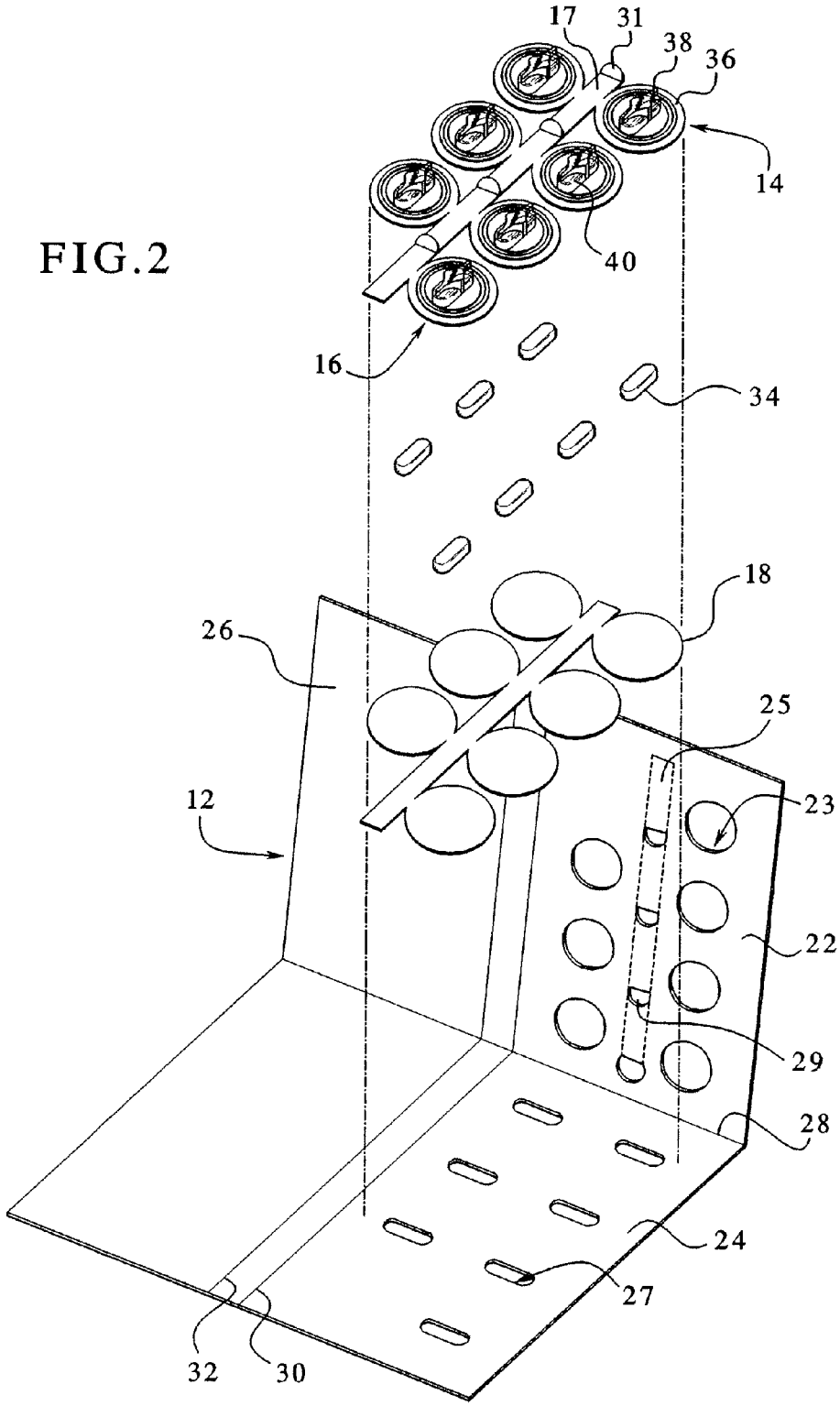
FIG. 2 is an exploded view of the childproof pharmaceutical dispensing blister pack of FIG. 1 showing the housing top sheet unfolded and rotated away from the housing bottom sheet, the blister sheet having a plurality of blisters removably attached to a removable zipper strip, a plurality of pills, and a foil layer.

Referring now to the drawings, and particularly to FIGS. 1 and 2, the improved childproof pharmaceutical dispensing blister pack of the present invention, generally designated by the numeral 10, is illustrated having a housing 12; a blister sheet 14 containing a plurality of blisters 16 and a zipper strip 17; and a thin film or foil sheet 18.

The housing 12 includes a top sheet 22, a bottom sheet 24 and a cover 26. Although the housing is shown in the figures as being constructed from a single sheet of material, it is appreciated that the housing may be comprised of multiple sheets or parts that are attached or initially separate pieces with respect to one another and not depart from the scope of the present invention. Furthermore, it is appreciated that the blister sheet may be used without a cover and not depart from the scope of the present invention.

The top sheet 22 of the housing includes a series of holes 23 shaped to receive the plurality of blisters 16. A zipper strip 25 may also be included on the top sheet 22 that may be removed in conjunction with, or beforehand, to allow the removal of the zipper strip 17 on the blister sheet 14. It is appreciated that the zipper strip 25 may be a uniform strip or may be comprised of a series of distinct strips that are individually located adjacent to a single blister or between a pair of blisters. Furthermore, it is appreciated that the zipper strips may be of a variety of sizes and/or shapes and not depart from the scope of the present invention.

Figure 3:
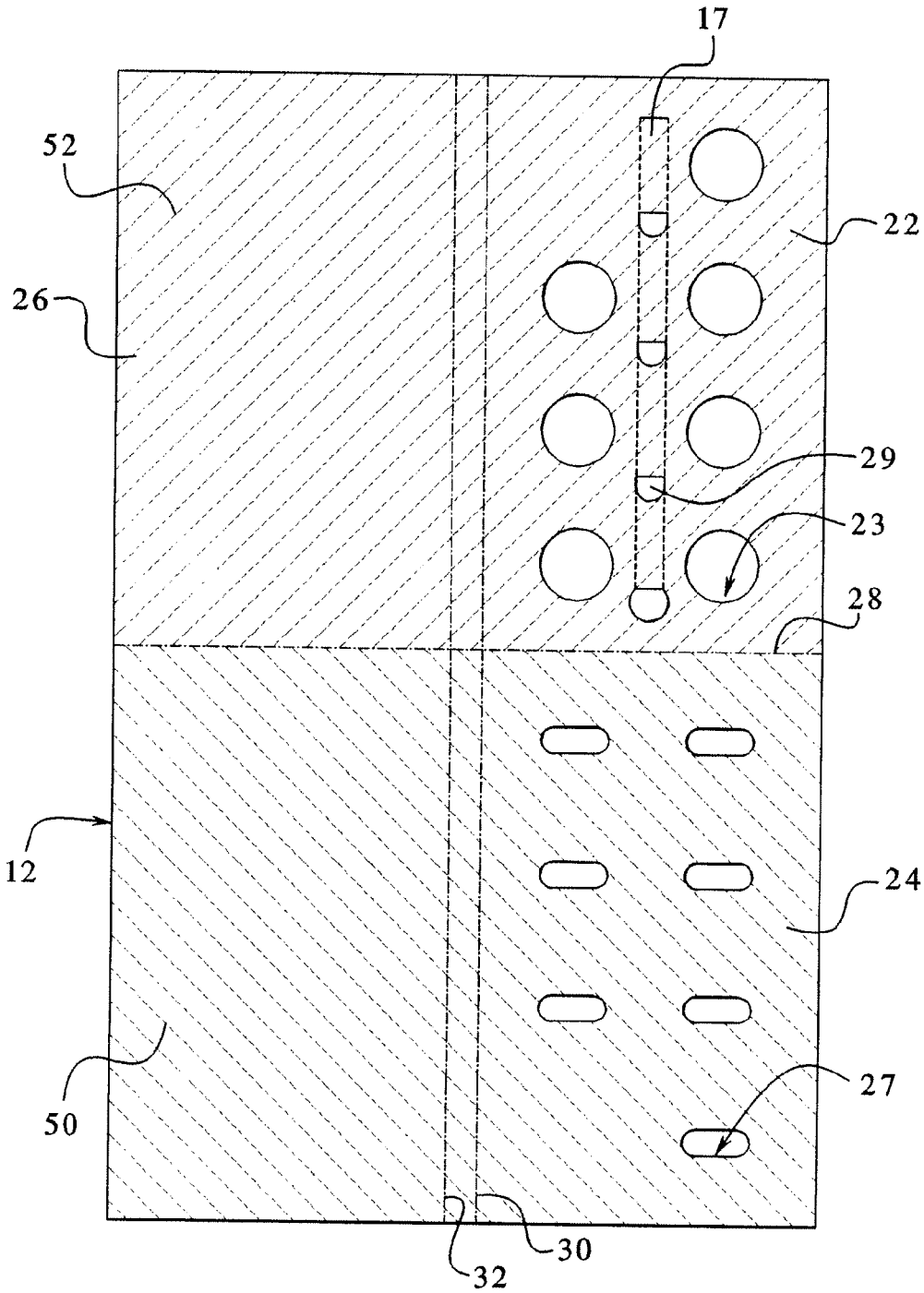
FIG. 3 is a vertical plan view of an unfolded single housing sheet showing a series of scored lines used to form the housing top sheet, housing bottom sheet, and cover for the childproof pharmaceutical dispensing blister pack.

As shown in FIGS. 1 to 3, it is preferred that when multiple zipper strips are utilized, the zipper strips 25 be separated by spaces or holes 29 to allow for the ends 31 of the zipper strips 17, as explained in more detail below, to extend through the holes 29. Having the ends of the strips extend through the holes facilitates the removal of the zipper strips from the housing and blister sheet to release a pair of blisters. It is further appreciated that the ends of the zipper strips may include a raised surface or node to facilitate the grabbing of the zipper strip. While a zipper strip 25 is shown, it is appreciated that the top sheet 22 may instead include a slot or other opening for accessing the zipper strip 17 of the blister sheet 14. As shown in FIGS. 1 to 5, the housing bottom sheet 24 has a series of dispensing slots 27 that are sized to allow the pills contained within the blisters 16 to be easily dispensed.

In order to facilitate the manufacture of the blister pack, the single sheet 20 of material may be scored as shown in FIG. 3. In particular, the housing 12 may include a first scored line 28 between the top sheet 22 and the bottom sheet 24 to allow the top and bottom sheets 22 and 24 to be folded on top of one another. The housing 12 may also include additional scored lines 30 and 32 to allow for the cover 26 to be folded over the blisters 16 when in use. It is appreciated that instructions or other information may be printed on the inside or outside surface of the cover.

The housing is preferably made from a SBS board coated on one side with a laminate material having directional grains 50, 52. Such material is easier to cut or tear in the direction of the grain, than against it. Hence, when two housing sheets are folded or otherwise placed on top of one another, instead of the unidirectional grain of the materials all going in the same direction or being parallel, (as it would in a single sheet of material which is less resistant to tearing or cutting in the direction of the grain) the grains 50, 52 of the overlapped sheets serve to overlap. The criss-crossing grains of the overlapped material add strength to the housing and protects against undesired tearing or cutting in two directions. An example of a suitable directional laminated material is a specialty film produced by Valeron Strength Films under the trademark VALERON™. While Valeron is made from a polyethylene material, other such coatings, such as, but not limited to, polypropylene or polyester may be used. While a SBS board coated with a laminated material is used, it is appreciated that other materials having single or multi-directional grains or sufficient strength to resist tearing, including, but not limited to, cloth films, cloth and plastic films, and heat sealable boards and other coatings may also be used and not depart from the scope of the present invention. Examples of such cloth films and cloth and plastic films include those films known by the names SCRIMM and CLAFF. It is further appreciated that the housing may be made from any other materials that are known to be used in blister packs such as, but not limited to, standard board stock, and not depart from the scope of the present invention.

Referring now to FIG. 2, the blister sheet 14 includes a plurality of blisters 16 for housing pills 34 and a zipper strip 17. Each blister 16 includes a base 36 and a cavity 38 for containing a pill 34. The cavity 38 is preferably shaped and positioned such that when the blister 16 contains a pill 34, the pill 34 extends substantially perpendicular to the dispensing slot 27 on the bottom sheet 22 of the housing 12 to prevent its removal from the blister pack. However, it is appreciated that the cavities and the pills therewithin may be positioned in any direction as long as they are neither substantially parallel to nor aligned with the dispensing slot when in the normal position. Hence other angles between the longitudinal axis of the slot and the longitudinal axis of the blister or pill may be used. In order to facilitate the turning of the blister 16, the blister may include a tab, bulge, protrusion or indentations 40 on the top or side of the blister. It is appreciated that the blister may be of various sizes and shapes and not depart from the scope of the present invention, with the understanding that the blister and the housing need to cooperate to enable rotation of the blister when released, while still securely holding the blister within the housing.

Figure 4:
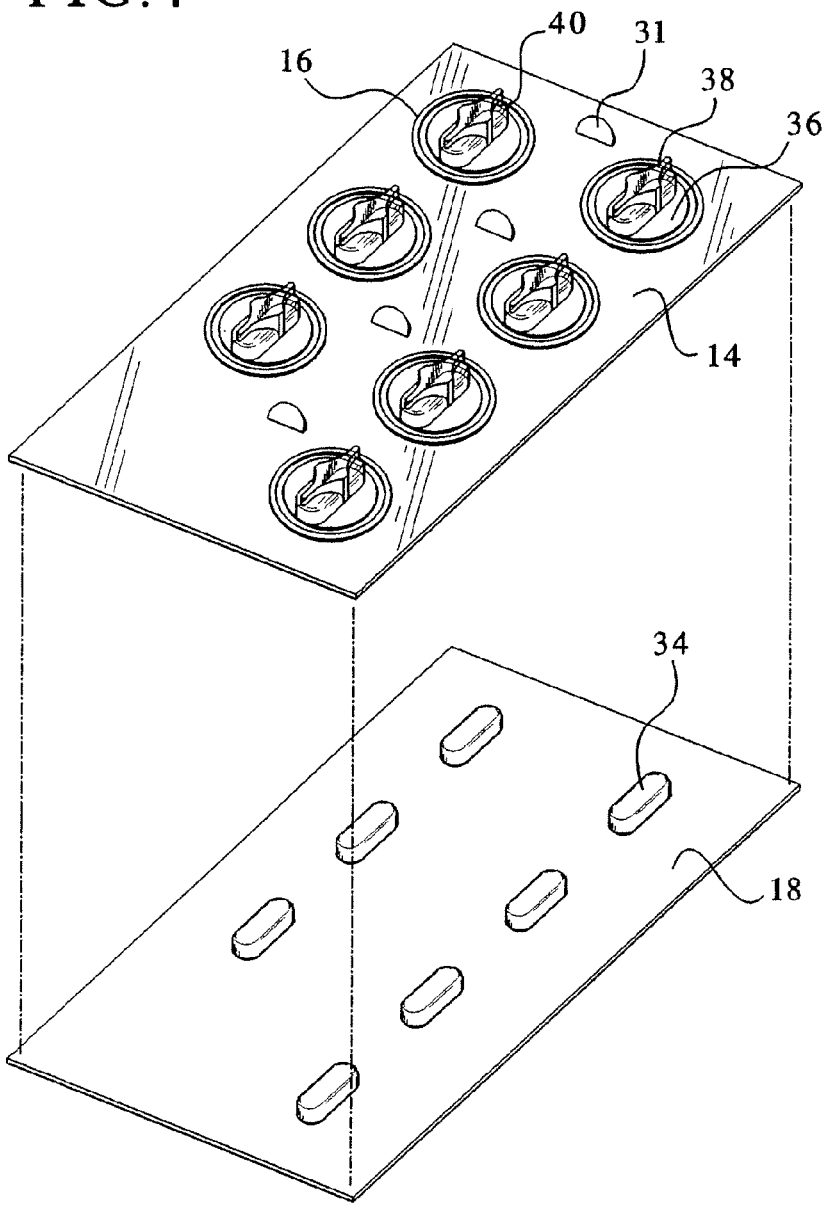
FIG. 4 is an exploded view illustrating a blister sheet of a childproof pharmaceutical dispensing blister pack before the blisters and zipper strip are cut away, and a thin film or foil sheet for placing over the pill dispensing slots to retain the pills within the cavities of the blisters.

Preferably, the blister sheet is molded from a substantially tear-resistant material, such as a 10 mil PVC, which is substantially transparent to enable the pills to be visible when contained within their respective cavities. However, it is appreciated that the blister sheet may be made from a variety of materials that are opaque, transparent or otherwise and not depart from the scope of the present invention. As shown in FIG. 4, the blister sheet 14 is preferably molded into a sheet that includes a plurality of blisters 16 and tabs for the ends 31 of the zipper strips 17. The blisters 16 and zipper strip 17 may then be cut away in a known way to form the blister sheet 14 shown in FIG. 2 for use with the present invention. Similarly, a foil sheet or thin film 18 is placed over the open end of the blisters 16 to maintain the pills 34 within the blisters 16. It is appreciated that the foil sheet or thin film may also be placed over the housing bottom sheet such that when the blister sheet is contained within the housing, the pills are contained within the cavities of the blisters. The foil sheet or thin film allows for the pills to be pushed through the film to dispense the pills. Although it is preferred that a thin film or foil sheet be used, it is appreciated that the dispensing slot may be uncovered or covered by another means including a removable cover.

Referring again to FIG. 2, the zipper strips 17 extends between two columns of blisters 16. In order to prevent the blisters from being twisted, rotated or turned, each zipper strip 17 is removably attached to the bases 36 of the blisters 16. While one zipper strip is shown as cooperating with two blisters or two rows of blisters, each blister or row of blisters can be provided with its own zipper strip. Furthermore, while the zipper strips are preferably kiss-cut or perforation-cut to the blisters, it is appreciated that they may be detachably attached to the blisters by other means and not depart from the scope of the present invention.

As shown in FIG. 1, the ends 31 of the zipper strips 17 extend through holes 29 in the housing top sheet 22 to enable the zipper strips 17 to be readily engaged by the user. A tab or similar device may be attached to the end 31 of the zipper strip 17 to facilitate the gripping and removal of the zipper strip. While a zipper strip is shown and described, it is appreciated that the blisters may be retained using other sorts of retaining members and not depart from the scope of the present invention.

In order to make the blister pack, a blister sheet 14 having a number of blisters 16 as shown in FIG. 4 is molded from a 10 mil PVC sheet. Pills, capsules or other objects 34 are then inserted into the cavities 38 of the blisters 16. With the pills inside the cavities of the blisters, a foil sheet or thin film 18 is attached to the bottom of the blister sheet 14 to seal off the cavities 38, thereby retaining the pills 34 in the cavities 38. The blister sheet 14 is then cut into a matrix having a plurality of blisters 16 kiss-cut, scored or perforation-cut to a zipper strip 17 and inserted into the housing 12 such that the blisters 16 extend through corresponding holes 23 in the top sheet 22 of the housing 12. In order to form the housing, the housing sheet is folded along a scored line 28 separating the top sheet 22 and the bottom sheet 24. The top and bottom sheets are then fixedly attached to one another using a heat-activated or other type of adhesive, or any known method such as, but not limited to, stables or other fasteners to securely retain the sheets together and prevent tampering of the blister pack. Once assembled, the blisters stick through the openings of the housing and are preferably retained by a peripheral flange of the base that is adjacent to and abuts against the underside of the top sheet of the housing. Additionally, the housing 12 also may be folded along additional scored lines 30 and 32 to provide a cover 26 for the blister pack 14. It is appreciated that the foregoing description represents a preferred method of making a blister pack of the present invention and that the invention is not limited to this particular method.

Figure 5:
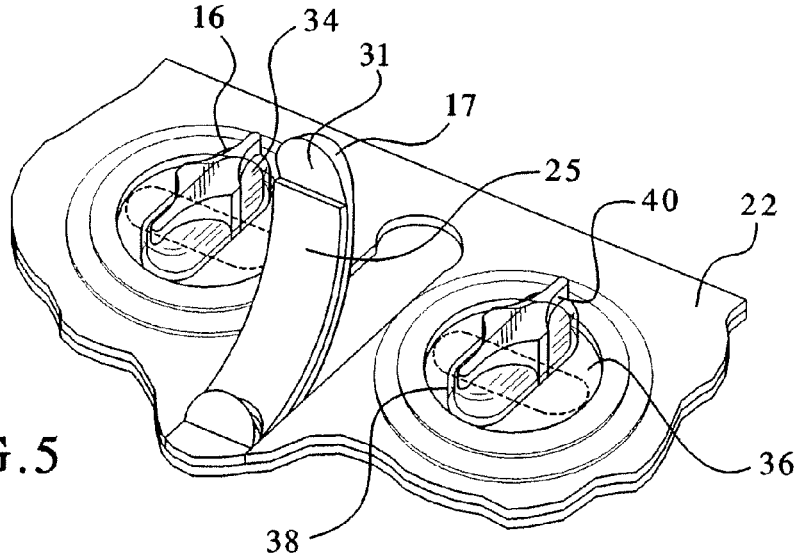
FIG. 5 is a partial perspective view of the childproof pharmaceutical dispensing blister pack of FIG. 1 showing the zipper strips partially removed from the housing top sheet and blister sheet and away from the first pair of blisters.
Figure 6:
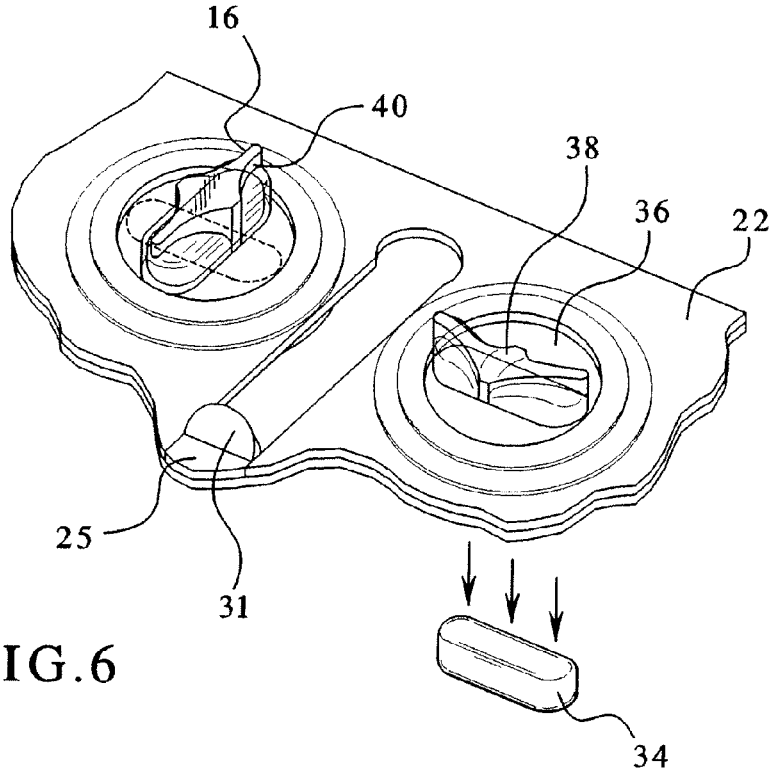
FIG. 6 is a partial perspective view of the childproof pharmaceutical dispensing blister pack of FIG. 1 illustrating a single blister being rotated 90 degrees to allow a pill to be dispensed.

In order to remove the pills 34, the end 31 of on the zipper strip 17, as shown in FIGS. 5 and 6, is pulled to remove the zipper strips 17 and 25 from the top sheet 22 of the housing 12 and the blister sheet 14. Removal of the zipper strip 17 from the blister sheet 14 disengages the strip 17 from the blisters 16 to which it was connected, thereby releasing the blisters 16 contained on the blister sheet 14 to allow the blisters 16 to be rotated or twisted 90 degrees (in this example) to align the pills 34 in the cavities 38 of the blisters 16 with the corresponding dispensing slots 27 on the bottom sheet 24 of the housing 12. The blisters 16 may then be pushed so as to drive and expel the pills 34 from the blister pack 10 through the film 18.

It is the two-step zipper strip pulling and blister twisting operation that makes the package substantially childproof because children are not likely to figure out how to release the blister for rotation and alignment with the dispensing slot, yet substantially senior-friendly because seniors should be able to perform these operations with a minimum of manual dexterity or with arthritis pain. Single, double or multiple dose versions of this embodiment should also be considered as part of the invention. Likewise, as indicated above, other blister sheets having any number of blisters, such as, but not limited to, 14 or 30 blisters, should be considered as being within the scope of the invention.

Figure 7:
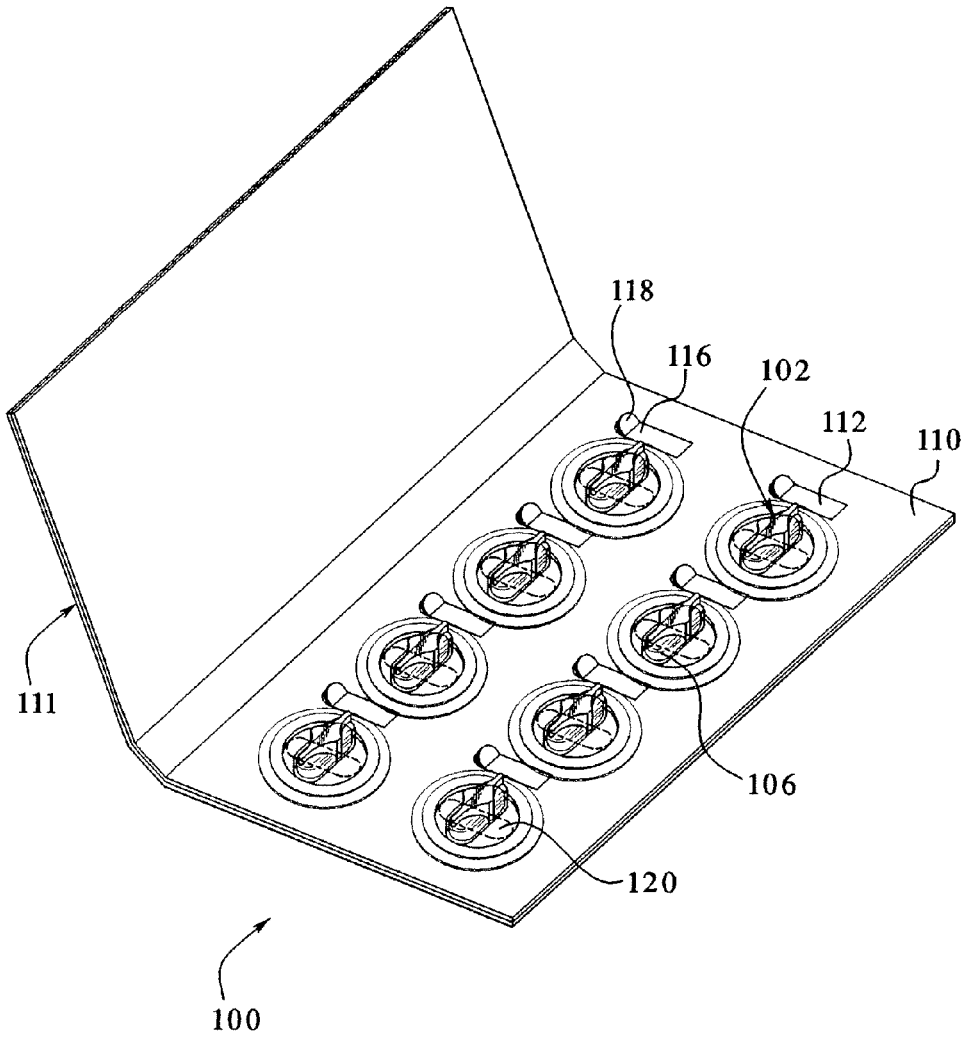
FIG. 7 is a perspective view of a blister sheet showing the blisters arranged in rows with a plurality of zipper strips attaching the bases of adjacent blisters.
Figure 8:
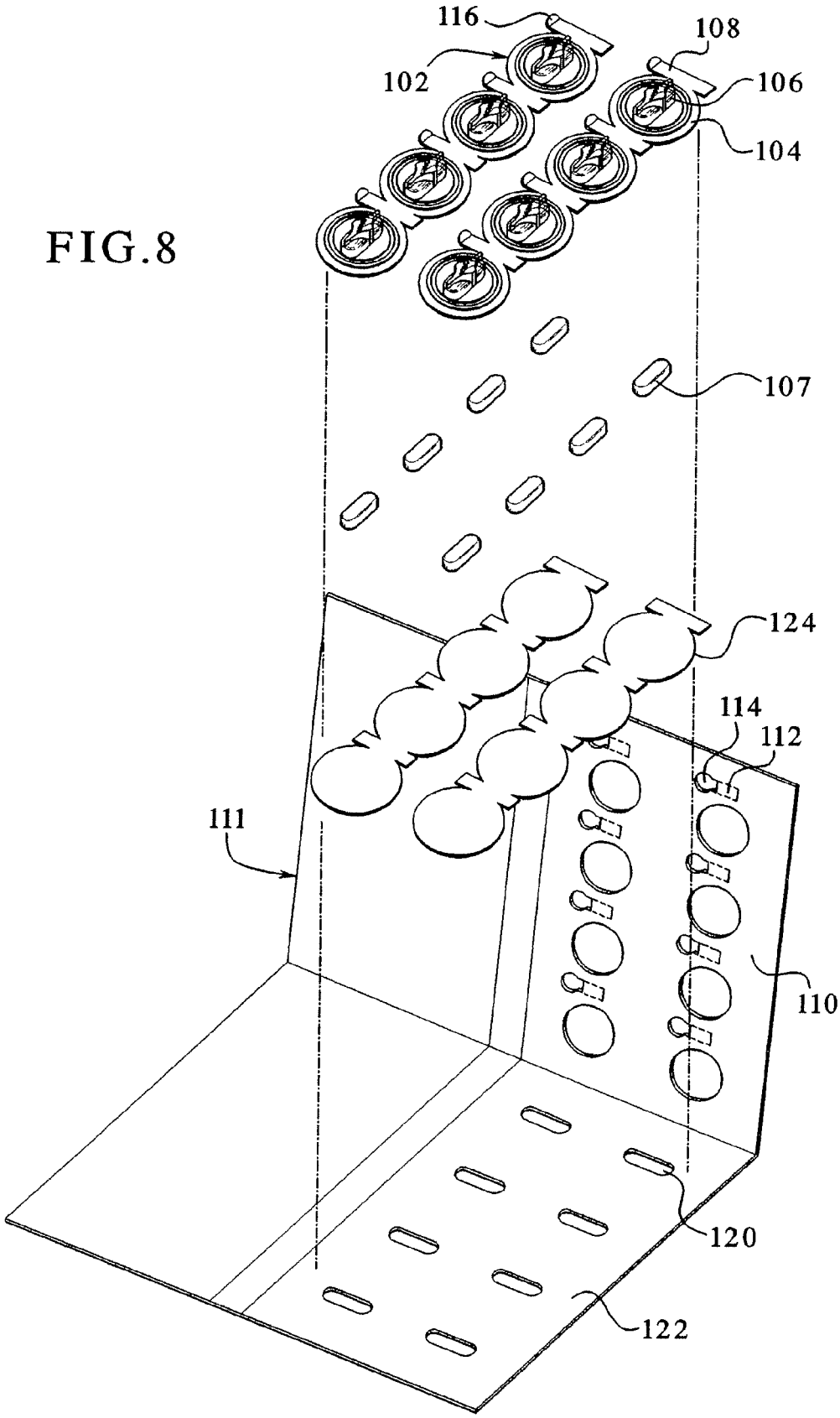
FIG. 8 is an exploded view of the childproof pharmaceutical dispensing blister pack shown in FIG. 7 showing the housing top sheet unfolded and rotated away from the housing bottom sheet; the blister sheet having a plurality of blisters arranged in two rows wherein the blisters are removably attached zipper strips to adjacent blisters; a plurality of pills, and a foil layer.

While a blister pack having seven blisters is shown in the figures, it is appreciated that the blister sheet may have any number of blisters and not depart from the scope of the present invention. Additionally, although a blister sheet having an even number of columns of blisters is shown so that a pair of blisters may be released at the same time, it is appreciated that the blisters on the blister pack may be arranged in any configuration, including in a single column or otherwise. For example, FIGS. 7 and 8 illustrate an alternate embodiment of a blister sheet for us in the type of housing shown and disclosed above, wherein the blisters 102 are arranged in two rows and each blister 102 includes a base 104 and a cavity 106 for housing a pill 107. As disclosed above, it is appreciated that the blister sheet may be made from a PVC sheet or other known materials.

Each of the adjacent blisters 102 in a row is attached at the base 104 to each of the adjacent blisters 102 by a zipper strip 108. In order to prevent the last blister in a row from being released with the penultimate blister, a zipper strip 108 is also preferably attached to the side of the last blister 102 in the row. The top sheet 110 of the housing 111 may also have a removable strip 112 to cover part of the zipper strip 108. A hole 114 in the top sheet 110 of the housing 111 of the blister pack 100 is preferably sized such that the end 116 of the zipper strip 108 extends into the hole 114 to allow for it to be grabbed to facilitate its removal. In order to facilitate the grasping of the zipper strip 108 and to prevent the last blister 102 from being rotated prior to removal of the zipper strip 108, the end 116 of the zipper strip 108 may also have a node 118 or other projection.

In operation, the pills 107 are arranged in the cavities 104 of the blisters 102 such that the pills 107 are not aligned with the dispensing slot 120 of the bottom sheet 122 of the housing 111. Removal of the zipper strip 108 and removable strip 112 releases one of the blisters 102. The blister 102 may then be rotated until the cavity 106 of the blister 102 aligns with the dispensing slot 120 of the bottom sheet 122 of the housing 111. The blister 102 may then be depressed to push the pill 107 through the foil sheet 124 covering the dispensing slot 120 to dispense the pill 107. Although it is preferred that a thin film or foil sheet be used, it is appreciated that the dispensing slot may be uncovered or covered by another means including a removable cover.

While two rows of four blisters are shown and disclosed, it is appreciated that any number of blisters may be used and arranged in any number of rows and columns. Additionally, it is appreciated that the zipper strips may be attached to one blister or to any number of blisters and not depart from the scope of the present invention.

Figure 9:
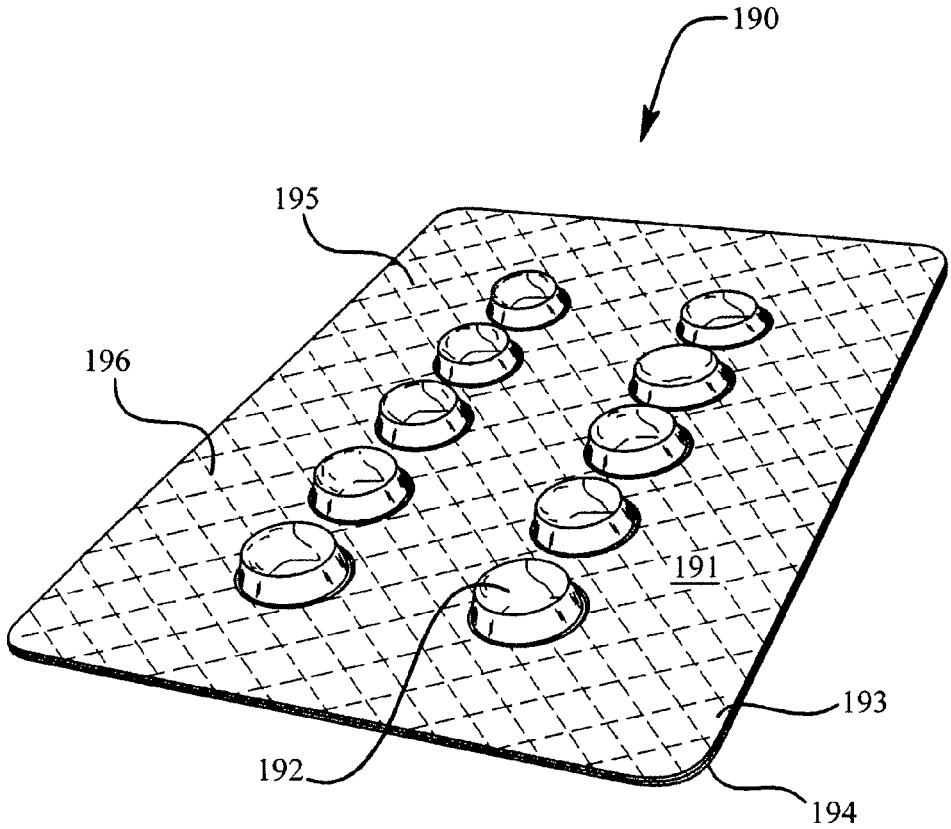
FIG. 9 is a perspective view of an embodiment of the blister pack providing criss-cross grain card material surrounding a plurality of blisters.

Turning to FIG. 9, another embodiment of a pill or other object dispensing blister pack 190 is shown. A criss-cross grain double layer card 191 includes a top sheet 193 and a bottom sheet 194 that surround and retain a plurality of blisters 192. While the blister pack is shown as having ten substantially round blisters, it is appreciated that the blister pack may have any number of blisters of varying shapes and not depart from the scope of the present invention. A plurality of dispensing slots are formed on the bottom of the card 191 and are covered with film or foil so that the pills contained in blisters 192 can be pushed through a thin film or foil sheet.

In the preferred embodiment, the housing is made from a SBS board coated on one side with a laminated material having directional grains 195, 196 that overlap so that when two housing sheets having grains 195 and 196 that extend in different directions are placed on top of one another such that the grains overlap, the criss-crossing grains of the materials add strength to the housing and protect against tearing or tampering in two directions. A suitable coating is manufactured under the trademark VALERON™ by Valeron Strength Films. While Valeron is made from a polyethylene material, other such coatings such as, but not limited to, polypropylene or polyester may be used. The material used also is preferably printable to allow for advertising, promotional or other information to be displayed on the housing. While a SBS board with a cross-laminated coating is preferred, it is appreciated that other materials having single or multi-directional grains or sufficient strength to resist tearing, including, but not limited to, cloth films, cloth and plastic films, heat sealable boards and other coatings, also may be used and not depart from the scope of the present invention. Examples of such cloth films and cloth and plastic films include those films known by the names SCRIM and CLAFF.

Figure 10:
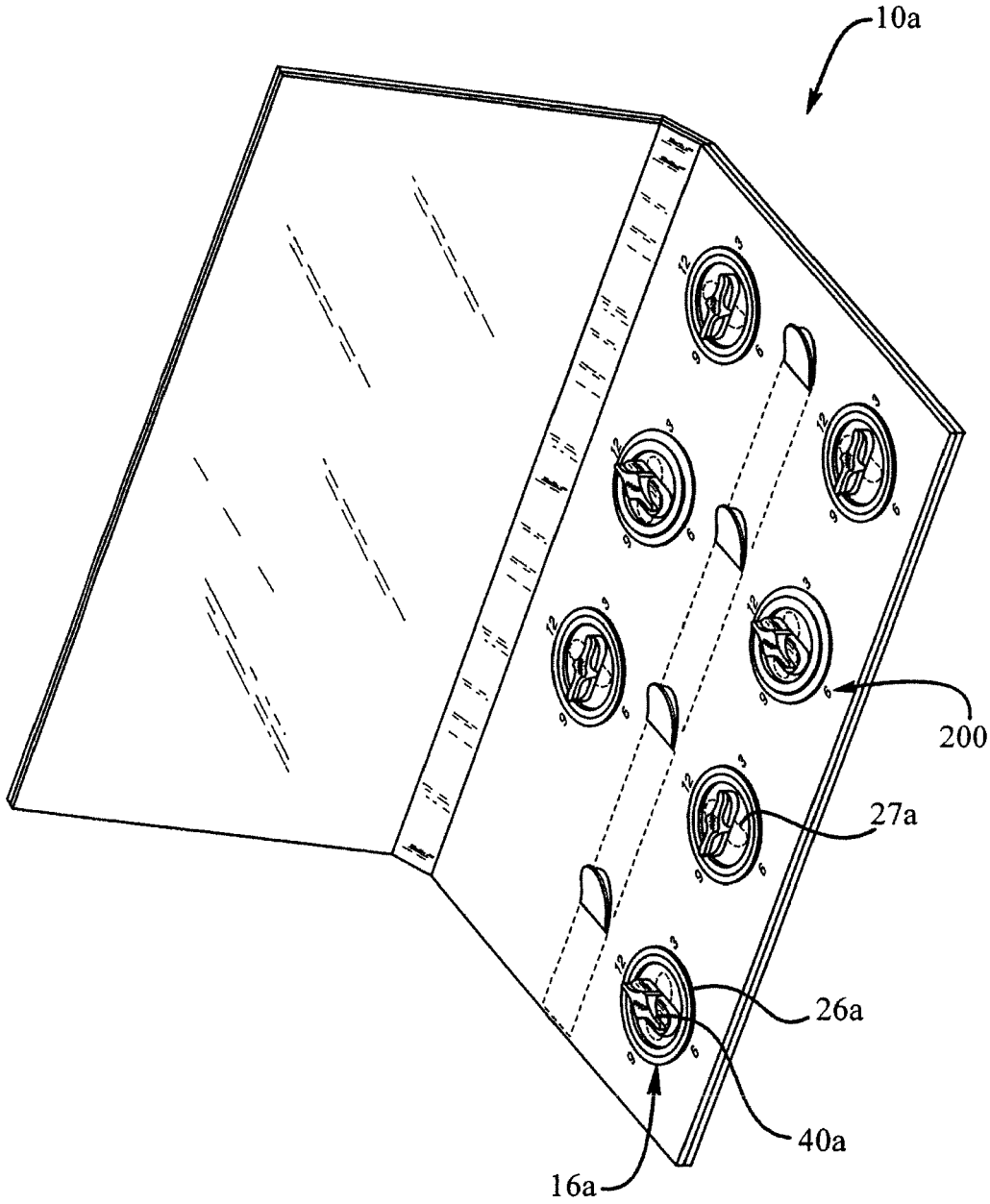
FIG. 10 is a perspective view of an embodiment of the childproof pharmaceutical dispensing blister wherein a clock dial is simulated about each blister and the dispensing slots are aligned so as to correlate and graphically illustrate when the pills should be taken.

As shown in FIG. 10, any of the blister pack 10*a* shown and disclosed herewithin may also include a simulated clock dial 200 about the periphery of each of the blisters 16*a*. As shown by the differing alignments of dispensing slots 27*a*, the alignment of the blisters 16*a* can be used to simulate or correlate to the times when the pills should be taken. For instance, when a pill should be taken every three hours, the cavities 40*a* of the blisters 16*a* can be aligned at 3 o'clock, 6 o'clock, 9 o'clock and 12 o'clock etc. so as to serve as a visual reminder or prompt of when and/or how often to take the medication. Alternatively, dispensing slots 27*a* could be aligned at 3 o'clock, 6 o'clock, 9 o'clock and 12 o'clock etc. so as to serve as a visual reminder or prompt of when and/or how often to take the pill as well as a visual record of when a pill was last taken. While a simulated clock face is shown and disclosed, it is appreciated that any number of symbols, simulated dials or other information may be included among the periphery of the blisters to relay information concerning the pill or other contents of the blister to the customer.

Figure 11:
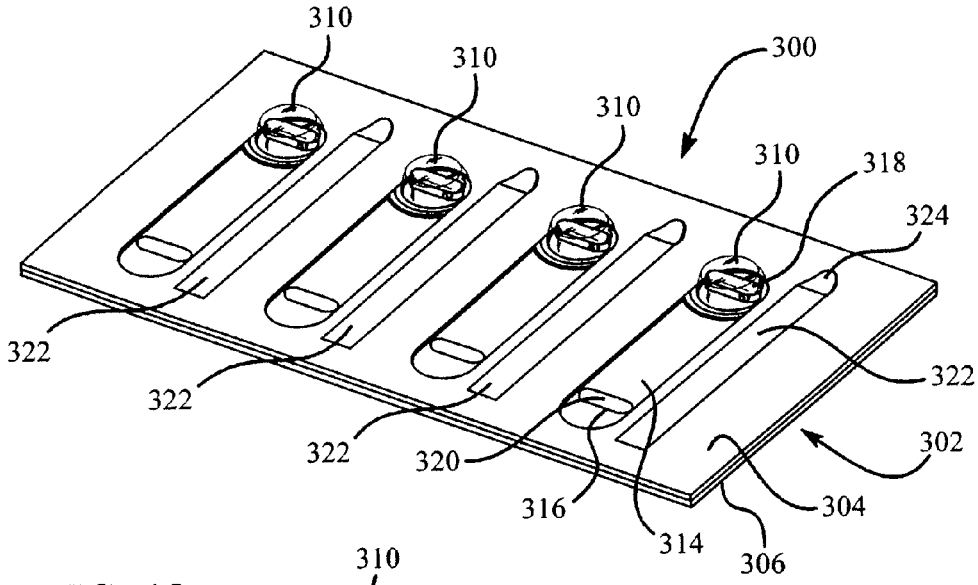
FIG. 11 is a perspective view of a slidable blisters embodiment of a childproof pharmaceutical dispensing blister pack showing the zipper strips of the blister sheet and housing still attached and the blisters in their normal position distal from the dispensing slots.
Figure 12:
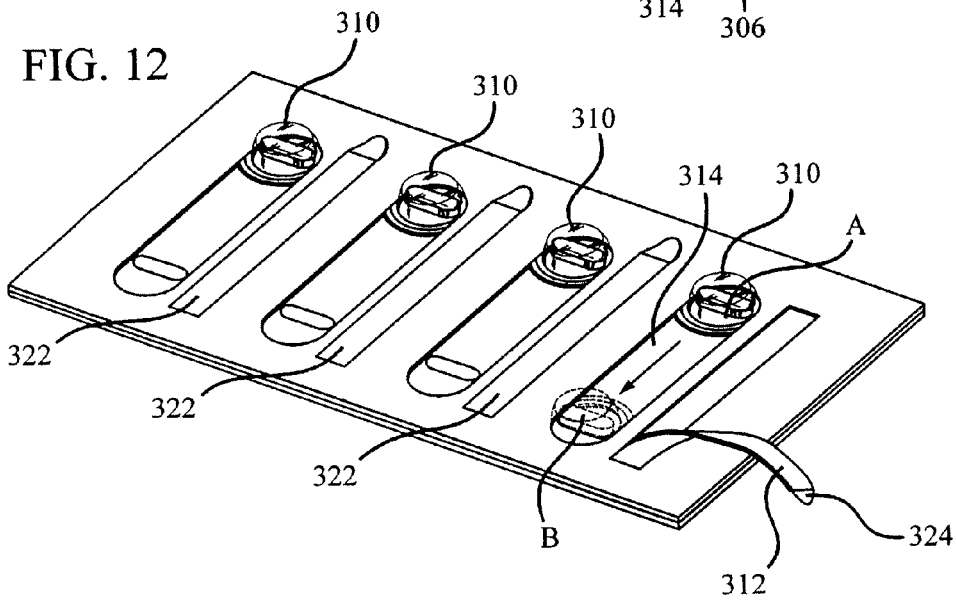
FIG. 12 is a perspective view of the slidable blisters embodiment of FIG. 11 showing a zipper strip partially removed from the housing and blister sheet to release a blister to allow it to move from its normal position to a position over the corresponding dispensing slot, as shown in phantom, to dispense the pill.

Referring to FIGS. 11 and 12, an alternative embodiment 300 of a blister pack having sliding blisters is shown. The blister pack 300 includes a housing 302 having a top sheet 304 and a bottom sheet 306 that enclose a blister sheet having a plurality of blisters 310 and a zipper strip 312 removably attached to the blisters 310. As disclosed above, the housing is preferably made from an SBS board coated on one side with a directional laminate, but may be made from other known materials and/or coatings and not depart from the scope of the present invention. The top sheet 304 of the housing 302 includes a series of slots or channels 314 shaped to receive the blisters 310 and allow the blisters 310 to move within the housing 302. A plurality of dispensing slots 316 are preferably located within the channels 314 distal from the normal position of the blisters 310 so as to prevent dispersal of a pill or other object 318 without releasing the blister 310. The dispensing slots 316 are preferably covered by a thin film or foil sheet 320 so as to maintain the pills within the blister while allowing the pill to be pushed through to permit removal of the pill. Although it is preferred that a thin film or foil sheet be used, it is appreciated that the dispensing slot may be uncovered or covered by other means including a removable cover. A zipper strip 322 also may be included on the top sheet 304, whereby the zipper strip 322 may be removed in conjunction with, or before, the removal of the zipper strip 312 on the blister sheet. While each blister 310 has a zipper strip 312 and a zipper strip 322 individually associated with it, it is appreciated that a pair of blisters 310 could share the zipper strips 312, 322 positioned between them.

In order to facilitate the removal of the zipper strips 312, 322, a tab 324 at the end of the blister sheet zipper strip 312 extends through a hole on the top sheet 304 to allow the tab 324 to be grasped to remove the zipper strip 312 so as to release the blister 310. Once released, the blister 310 can be slid along the channel 314 from position A and into vertical alignment with the corresponding dispensing slot 316 in position B. The pill 318 within the blister 310 can then be pushed through the film 320 covering the slot 316. While four sliding blisters 310 are illustrated, other arrangements having one or more blisters 310 and channels 314 should be contemplated as being within the scope of the invention. It is the two-step zipper strip pulling and blister sliding operation that makes the package substantially childproof, yet senior-friendly because seniors should be able to perform these operations with a minimum of manual dexterity or with arthritis pain. It is further appreciated that the pill may initially be misaligned with the dispensing slot. Accordingly, in order to dispense the pill 318 through the dispensing slot 316, the blister 310 must be slid and rotated within the channel 314 until the pill 318 is aligned with the dispensing slot 316.

Figure 13:
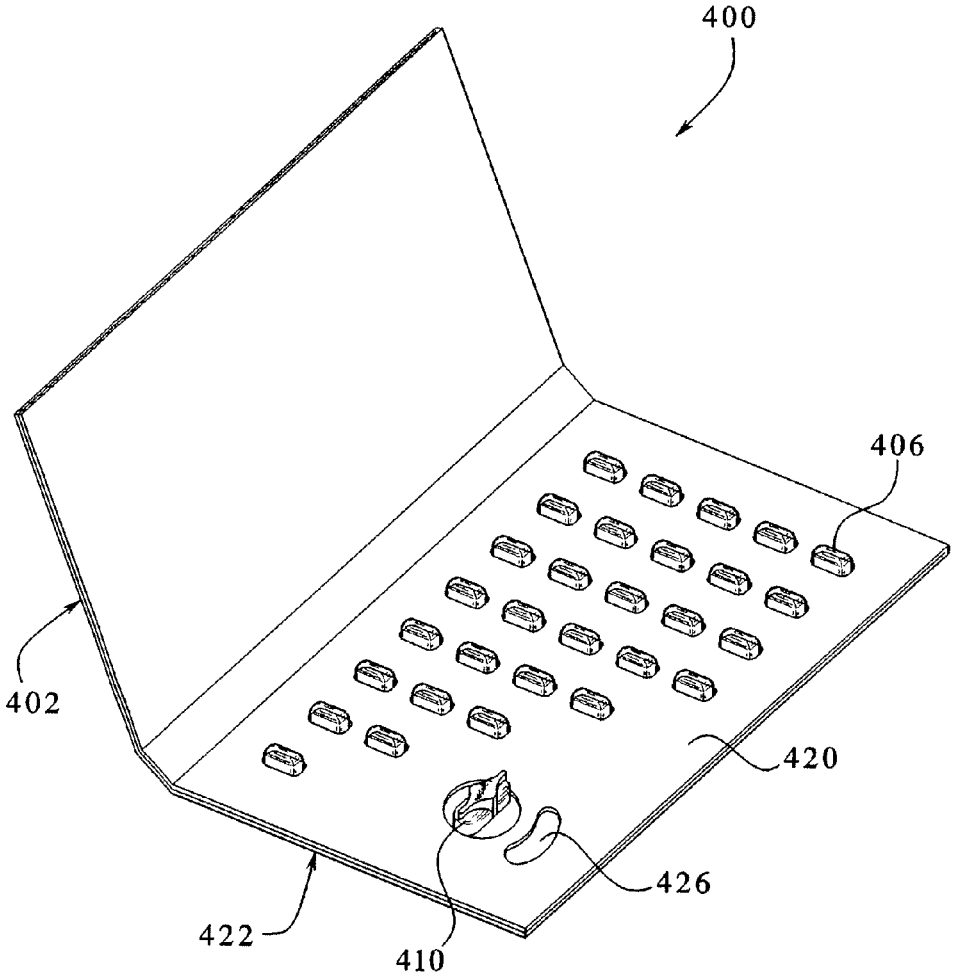
FIG. 13 is a perspective view of another embodiment of a childproof, senior-friendly pharmaceutical dispensing blister pack showing a plurality of blisters and a pill dispensing area.
Figure 14:
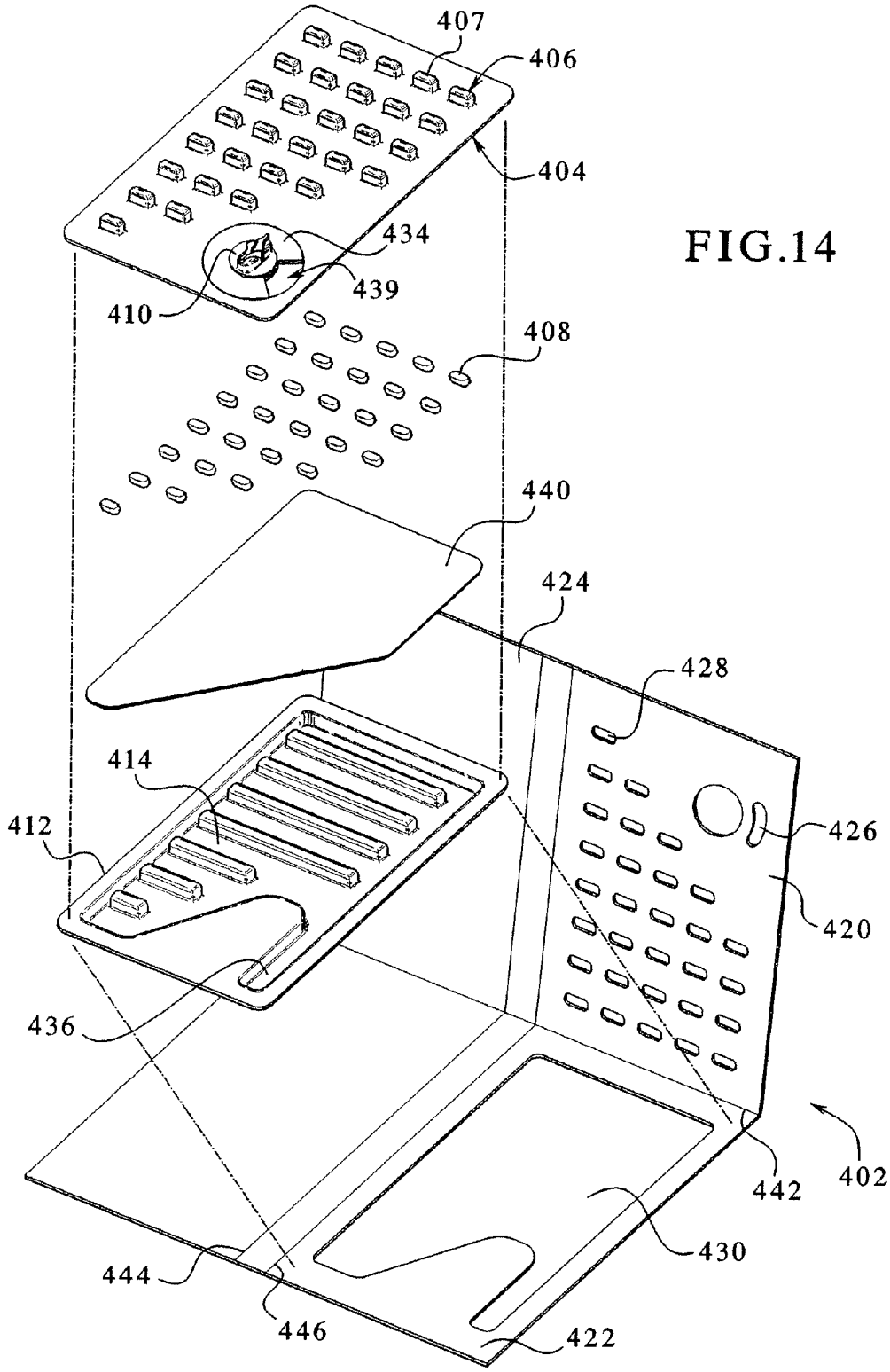
FIG. 14 is an exploded view of the blister pack of FIG. 13 showing a first plastic sheet having a plurality of blisters for storing pills and a second plastic sheet having a plurality of channels for transporting the pills to the pill dispensing area.

Referring to FIGS. 13 & 14, another embodiment of a blister pack is shown. The blister pack, generally designated by the number 400 is illustrated having a housing 402, a blister sheet 404 containing a plurality of blisters 406 for housing pills 408 and a twistable or turnable blister 410 associated therewith; and a second blister sheet 412 having a plurality of channels 414 for moving the pills from their blisters to the turnable blister 410 for dispensing.

The housing includes a top sheet 420, a bottom sheet 422 and a cover 424. Although the housing is shown as being constructed from a single sheet of material, it is appreciated that the housing may be comprised of multiple sheets that are attached to one another and not depart from the scope of the invention. Furthermore, while the housing preferably includes a cover, it is appreciated that the blister pack may forego a cover and not depart from the scope of the present invention.

The top sheet 420 of the housing 402 includes a dispensing slot 426 and a plurality of holes 428 sized and shaped to receive the blisters 406 and the turnable blister 410. It is appreciated that the dispensing slot 426 may initially be covered in a known way such as, but not limited to, a pull-away zipper strip.

The bottom sheet 422 of the housing 402 preferably includes a hole 430 sized and shaped to accommodate all of the channels 414 of the second blister sheet 412. While a large hole is shown and disclosed, it is appreciated that there may be multiple holes to accommodate the various channels or the housing may be of sufficient depth such that the channels may be entirely contained within the housing so that the bottom sheet may be a uniform sheet without any holes.

The housing is preferably made from a SBS board coated on one side with a laminate material having directional grains that overlap when two housing sheets are folded or otherwise placed on top of one another to add strength to the housing and further protect against undesired tearing or cutting. Such material is easier to cut or tear in the direction of the grain, than against it. Hence, when two housing sheets are folded or otherwise placed on top of one another, instead of the unidirectional grain of the materials all going in the same direction or being parallel, (as it would in a single sheet of material having uni-directional grain which is less resistant to tearing or cutting in the direction of the grain) the grains of the overlapped sheets serve to overlap. The crisscrossing grains of the overlapped material add strength to the housing and protects against undesired tearing or cutting in two directions. An example of a suitable laminated material having directional grains is a specialty film produced by Valeron Strength Films under the trademark VALERON™. While Valeron is made from a polyethylene material, other such coatings including, but not limited to, polypropylene or polyester may be used.

While a SBS board coated with a laminated material is used, it is appreciated that other materials having single or multi-directional grain or sufficient strength to resist tearing, including, but not limited to, cloth films, cloth and plastic films, heat sealable boards and other coatings, may also be used and not depart from the scope of the present invention. Examples of such cloth films and cloth and plastic films include those films known by the names SCRIMM and CLAFF. It is further appreciated that the housing may be made from any other materials that are known to be used in blister packs such as, but not limited to, standard board stock, and not depart from the scope of the present invention.

Referring again to FIG. 14, the blister sheet 404 includes a plurality of blisters 406 having cavities 407 for housing pills, and a twistable or turnable blister 410 attached to or associated with a flange 434. While a blister sheet having seven columns of between one and five pills is shown, it is appreciated that the blister sheet may have any number of blisters arranged in any number of columns and/or rows and not depart from the scope of the invention. It is further appreciated that the individual columns or rows may represent the particular pills that must be taken in a specific time period (e.g., one day) to facilitate the process of taking the necessary pills.

The second blister sheet 412 includes a plurality of first channels 414 that correspond to the columns or rows of blisters from the blister sheet 404. The channels 414 extend into a second channel 436 that traverses the plurality of the channels 414. While it is preferred that a second channel be used, it is appreciated that the blister pack may use one or more first channels that are each preferably associated with an individual dispensing mechanism and not depart from the scope of the present invention. Furthermore, while the pills may be dispensed through the dispensing slot 426, it is appreciated that the end of the second channel 436 may include a dispensing slot that may initially be covered by a thin film of other covering. Removal of the covering will thus allow the pills to be dispensed through the slot.

In order to make the blister pack, the blister sheet is molded from a substantially tear-resistant material, such as a 10 mil PVC, which is substantially transparent to enable the pills to be visible when contained within their respective cavities. However, it is appreciated that the blister sheet may be made from a variety of opaque, transparent or other known materials and not depart from the scope of the present invention. In particular, the first blister sheet 404 and second blister sheet 412 are preferably molded and constructed such that the first blister sheet has a plurality of blisters aligned in one or more columns or rows and a turnable blister associated therewith, and the second blister sheet has one or more first channels extending in the same direction as the columns or rows from the blister sheet and a second channel running traversely to the one ore more first channels. Each of the blisters includes a cavity for housing a pill.

It is appreciated that the twistable or rotatable blister is preferably a separate element so that it may be rotated in relation to the first blister sheet. While a rotatable blister having a pill-shaped cavity to facilitate the grasping and rotation of the blister is shown and disclosed, it is appreciated that the blister also may comprise bulges comprising grasping surfaces of different sizes and shapes. Additionally, it is appreciated that the blister may be turned using any known means including, but not limited to, a slot for insertion of an object such as, but not limited to, a coin or key-like object, whereby the coin or other object may be turned, twisted or pushed after it is placed within the slot to turn the blister.

Once the blister sheets are molded, the pills may then be placed in the cavity of the blister. With the pills inside the cavity of the blister, a foil sheet 440 or other cover is attached to the bottom of the blister sheet 404. Although it is preferred that a thin film or foil sheet be used, it is appreciated that the dispensing slot may be uncovered or covered by other means. After the pills are inserted into the cavities and covered by the foil cover, the blister sheet may then be attached to the second blister sheet in a known way including, but not limited to, adhesive, tape and/or staples and the like.

In order to form the housing, the housing sheet is folded along a scored line 442 separating the tops sheet 420 and the bottom sheet 422. With the blister sheets arranged in between the top and bottom sheets 420, 422, the top and bottom sheets may then be fixedly attached to one another using a heat-activated or other type of adhesive or any known method such as, but not limited to, tape, staples and/or other fasteners to securely retain the sheets together and prevent tampering of the blister pack. The housing also may be folded along additional scored lines 444, 446 to provide a cover 424 for the blister pack. It is appreciated that the foregoing description represents a preferred method of making the blister pack of the present invention and that the invention is not limited to this particular method.

In order to remove the pills, the cavity 407 of the blister 406 is depressed to push a pill 408 through the foil sheet and into the respective first channel. The blister pack may then be tilted or moved to allow the pill 408 to travel down the first channel 414 and into the second channel 436. In the preferred embodiment, the turnable or rotatable blister 410 includes a flange 434 that initially blocks passage of the pill 408 to the dispensing slot 426 prior to activation. In the preferred embodiment, the flange includes a hole or gap 439 that is sized to allow for the pill 408 to travel through the dispensing slot 426 to be dispensed. In operation, rotation of the blister 410 moves the flange 434 away from the slot 426, thereby aligning the hole 439 with the dispensing slot 426 to allow the pill 408 to be dispensed from the blister pack.

It is further appreciated that the rotatable blister may be temporarily locked into a closed or open position. While it is appreciated that the blister may be locked into position in one of a variety of known ways, one embodiment comprises a push and turn blister. As shown in FIG. 15, the rotatable blister, generally designated by the numeral 410 includes at least one retaining member 450 that extends downwardly from the rotatable blister 410. In a preferred embodiment, the retaining member has a body 456 and a retaining end 458. The second blister sheet preferably includes a substantially circular or semi-circular member 459 that is substantially the same size as the center section 452 of the rotatable blister 410, but it is appreciated that it may be of other shapes and sizes. The circular member 459 preferably includes a plurality of recesses or holes 454 for accepting the retaining end 458 of the retaining member 450. When not in use, the retaining end 458 of the retaining member 450 is preferably positioned in one of the recesses 454 such that the dispensing slot 426 is covered by the flange 434 and the blister 410 is prevented from being rotated. Pushing on the blister 410 displaces the retaining end 458 of the retaining member 450 from the recess 454 and allows the blister 410 to be rotated. In order to allow the blister to be rotated, the second blister sheet 412 preferably includes a groove or channel 457 that is sized to permit the retaining end 458 to move between the two recesses. Once rotation begins, the blister 410 preferably no longer needs to be pushed. Rotation of the blister will continue until the retaining end of the retaining member passes over and falls into the next recess, whereby the flange will be removed from the traverse second channel to allow the pill to proceed to the dispensing slot to be dispensed.

Furthermore, it is appreciated that the traverse second channel or dispensing slot may be temporarily blocked in any number of ways including, but not limited to, a slidable panel or wall that may selectively block passage of the pill. It is appreciated that in order to block passage of the pills to the respective dispensing slot, the second channel 436 of the second blister sheet 412 may include a slot or hole in its sidewall 455 to allow a wall or other member to be inserted into the second channel 436 to block passage of the pill to the dispensing slot 426.

FIG. 16 shows another embodiment of a substantially childproof and senior-friendly pill dispensing mechanism for use with the blister packs of the type shown in FIGS. 13 and 14. The pill dispensing mechanism, generally identified by the reference number 460, comprises a cover member 462 that is slidably housed within a cover member channel 464 to permit the cover member 462 to be slid to reveal the dispensing slot 466 for dispensing the pill.

In the preferred embodiment, when in a first position designated by reference letter A, the cover member 462 covers the dispensing slot 466, thereby preventing the housed pill from being dispensed. By moving or sliding the cover member 462 within the cover member channel 464 to a second position generally designated by the letter B (shown in phantom), the dispensing slot 466 is uncovered, thereby allowing the pill to be dispensed through the slot. The cover member 462 may thereafter be pushed back into position A to prevent further dispensement of any pills. While the embodiment shown and disclosed requires the cover member to be manually moved between position A and position B, it is appreciated that the cover member may be automatically returned to position A through a known way such as, but not limited to, springs, rubber bands, or other elastic-like elements serving to bias the cover to a closed position. It is further appreciated that the cover member may initially be prevented from movement within the cover member channel through the use of a zipper strip 468 that is initially removably attached to the cover member in a known way such as, but not limited to, kiss-cut or other detachable methods. Removal of the strip thereby releases the cover member and allows it to be moved or to slide within the cover member channel to prevent pills from being dispensed.

It will be understood that modifications and variations may be effected without departing from the scope of the novel concepts of the present invention, but it is understood that this application is limited only by the scope of the appended claims.

The invention claimed is:

1. A method of forming a blister pack for dispensing an object comprising the steps of:

filling a blister having an interior cavity with an object by placing said object substantially within said cavity, said cavity having a longitudinal axis;

forming said blister into a blister pack by combining it with a card assembly having a dispensing opening formed therein, such that said blister is operably retained by said card in a storage position;

securing the blister in the blister back so that it may be moved from a storage position to a dispensing position; and permitting the blister to move to the dispensing position wherein said object is substantially aligned with said dispensing opening so as to permit passage of said object through said opening, wherein said longitudinal axis of the cavity in the storage position being in a different direction than the longitudinal axis in the dispensing position.

2. The method of claim 1 wherein said method further includes providing a releasing member that may be moved to release said blister for movement prior to moving said blister to said dispensing position.

3. The method of claim 2 wherein the releasing member is a zipper strip.

4. The method of claim 1 wherein said step of moving of the blister comprises rotation of said blister.

5. The method of claim 1 further including said step of pushing of the object through said dispensing opening.

6. The method of claim 1 wherein said dispensing opening is a substantially slot-shaped opening, sized to enable said object to pass therethrough when said blister is in said dispensing position.

7. The method of claim 1 wherein the card assembly further comprises a plurality of symbols surrounding said blister, wherein the cavity of said blister is initially aligned with one or more symbols to indicate information regarding the object.

8. The method of claim 7 wherein the object is a pill and the symbols comprise a clock face having a plurality of numbers surrounding the blisters, and wherein the cavity of the blister is initially aligned with a number on the clock face to indicate when to take the pill.

9. The method of claim 1 wherein the longitudinal axis of the cavity in the storage position is initially at about a 90-degree angle from the longitudinal axis of the cavity when moved to the dispensing position.

* * * * *

UNITED STATES PATENT AND TRADEMARK OFFICE

CERTIFICATE OF CORRECTION

PATENT NO. : 7,784,250 B2
APPLICATION NO. : 12/130363
DATED : August 31, 2010
INVENTOR(S) : Glenn A. Grosskopf It is certified that error appears in the above-identified patent and that said Letters Patent is hereby corrected as shown below:

Column 3
Line 60, between “attached” and “zipper”, insert --by--.

Column 4
Line 50, replace “sheet” with --pack--.

Column 5
Line 61, between “Hence” and “other”, insert --,--.

Column 6
Line 62, replace “stables” with --staples--.

Column 7
Line 6, delete “on”.
Line 40, replace “us” with --use--.

Column 8
Line 46, replace “pack” with --packs--.

Column 11
Line 44, replace “tops” with --top--.

Column 13
Line 25, replace “back” with --pack--.

Signed and Sealed this

Thirtieth Day of November, 2010

David J. Kappos

David J. Kappos
*Director of the United States Patent and Trademark Office*